US008375614B2

(12) United States Patent
Stephenson

(10) Patent No.: US 8,375,614 B2
(45) Date of Patent: Feb. 19, 2013

(54) WET FLOOR WARNING DEVICES AND METHODS

(76) Inventor: Dagmar Stephenson, Thunder Bay (CA)

( * ) Notice: Subject to any disclaimer, the term of this patent is extended or adjusted under 35 U.S.C. 154(b) by 0 days.

(21) Appl. No.: 13/185,371

(22) Filed: Jul. 18, 2011

(65) Prior Publication Data

US 2012/0017478 A1 Jan. 26, 2012

Related U.S. Application Data

(60) Provisional application No. 61/364,872, filed on Jul. 16, 2010.

(51) Int. Cl.
*G09F 15/00* (2006.01)

(52) U.S. Cl. ..... 40/606.15

(58) Field of Classification Search ..... 40/606.15, 40/611.02, 593; 116/303
See application file for complete search history.

(56) References Cited

U.S. PATENT DOCUMENTS

| | | | | | |
|---|---|---|---|---|---|
| 823,782 | A * | 6/1906 | Holden | 116/215 |
| 3,539,204 | A * | 11/1970 | Keller | 281/45 |
| 3,850,401 | A * | 11/1974 | Snediker | 248/292.13 |
| 3,941,340 | A * | 3/1976 | Rankins | 248/514 |
| 4,028,827 | A * | 6/1977 | Hufton | 40/600 |
| 4,829,687 | A * | 5/1989 | Rumpf | 40/606.15 |
| 5,377,945 | A * | 1/1995 | Steinke | 248/292.11 |
| 6,779,479 | B1 * | 8/2004 | Agius | 116/284 |
| 2003/0033742 | A1 * | 2/2003 | Perelli et al. | 40/606 |
| 2008/0078112 | A1 * | 4/2008 | Basha | 40/606.15 |
| 2010/0101483 | A1 * | 4/2010 | Cossaboom | 116/303 |

* cited by examiner

*Primary Examiner* — Joanne Silbermann
*Assistant Examiner* — Kristina Junge
(74) *Attorney, Agent, or Firm* — Kyle R. Satterthwaite; Ryan W. Dupuis; Ade & Company Inc.

(57) ABSTRACT

Apparatus and methods for wet floor warnings feature a movable barrier member proximate a doorway at a height elevated above floor level for selective movement between a deployed position in which the barrier member spans at least partially across the doorway and a storage position in which the barrier member is less obstructive to the doorway than in the deployed position for selective display of wet floor warning indicia on the barrier member on a path of sight through the doorway to indicate that the floor surface situated beyond said doorway is wet and may present a slip and fall hazard. The visibility of the warning is improved over floor seated signs, and cleaning personnel going room to room in a large establishment like a hotel, hospital, nursing home, care home, etc. need not transport portable warning signs as they travel the premises.

17 Claims, 3 Drawing Sheets

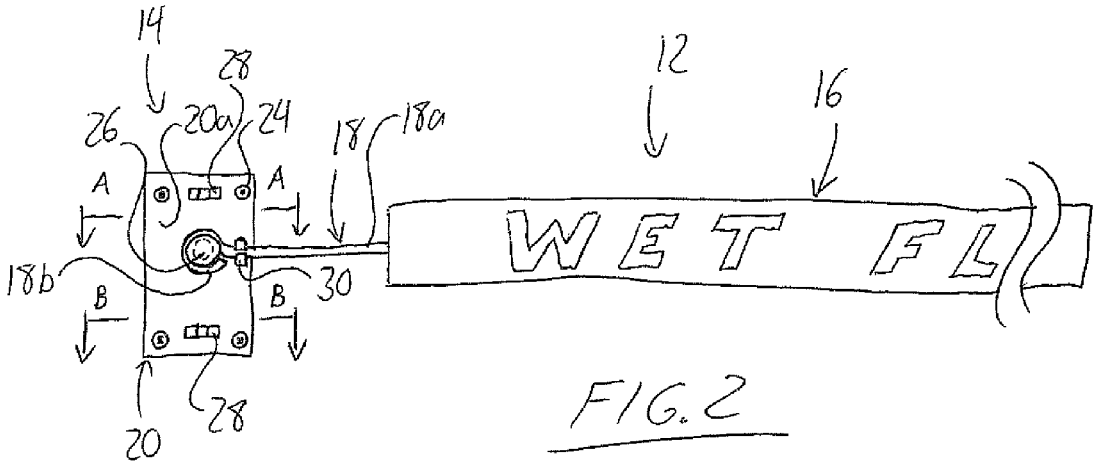
FIG. 2
FIG. 3
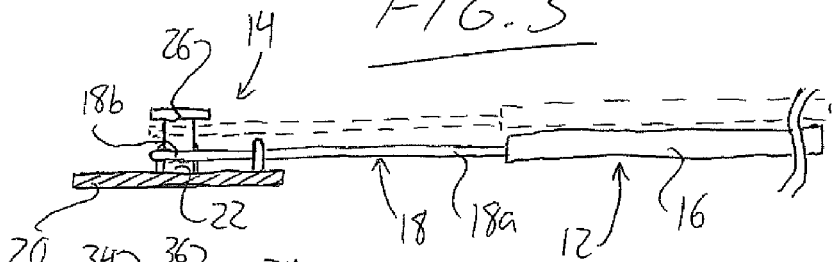
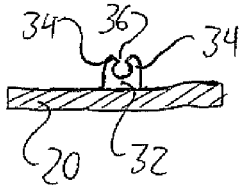
FIG. 4

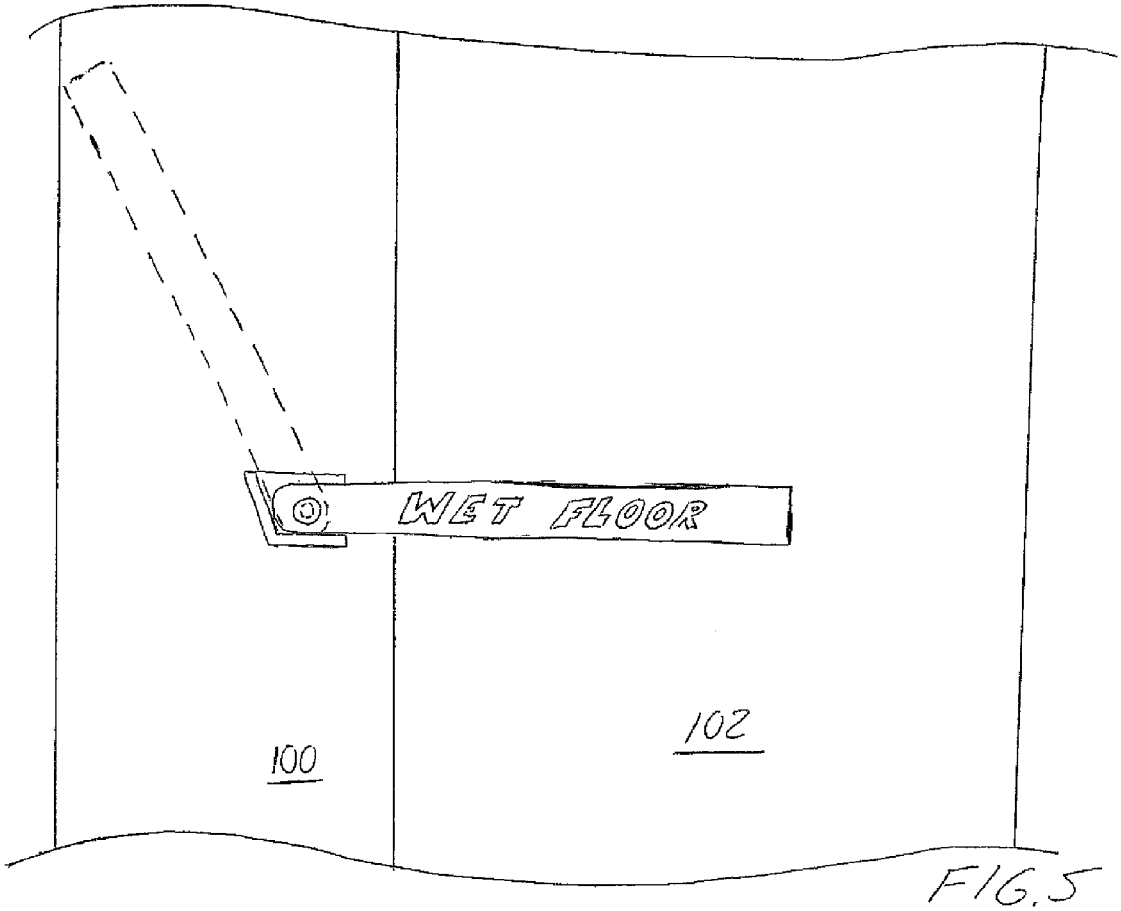
FIG. 5
FIG. 6
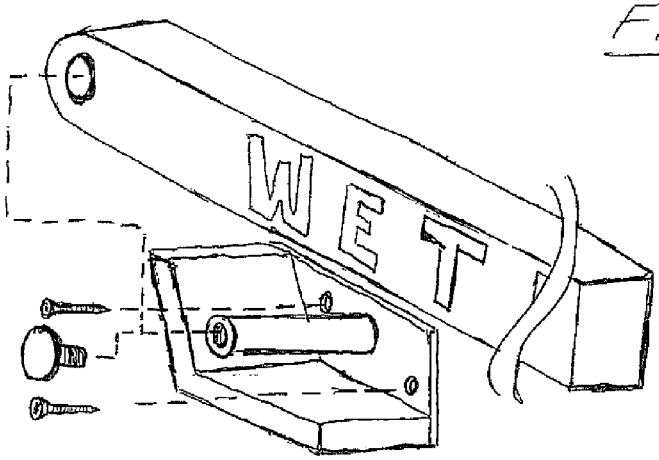

WET FLOOR WARNING DEVICES AND METHODS

CROSS REFERENCE TO RELATED APPLICATIONS

This application claims benefit under 35 U.S.C. 119(E) of U.S. Provisional Patent Application Ser. No. 61/364,872, filed Jul. 16, 2010.

FIELD OF THE INVENTION

The present invention relates to wet floor warning signs and barriers, and more particular to a wet floor warning and barrier device to be mounted at a doorway on a permanent or long-term basis for selective deployment across the doorway whenever needed to warn approachers of a wet floor beyond the doorway.

BACKGROUND OF THE INVENTION

It is well known to try and prevent slip and fall injuries by employing wet floor signs to warn people that a hard floor surface may be slippery after having been cleaned. Conventional wet floor signs are positioned on the floor itself, and can often go unnoticed by passersby who are not directing their sightlines downward to focus on the floor and other low-level objects. One solution to this has been to employ a hanging sign that is removably mounted across a doorway to provide an indication of wet floor conditions or room cleaning procedures existing or taking place in the room or area beyond the door. The sign employs a telescopic post that is spring biased into an extended condition, so that it can be manually collapsed to fit between the jambs of a doorway, and then allowed to expand against the jambs to suspend the post in doorway at a readily visible height and hang a "closed for cleaning" or other wet-floor or hazard sign from the generally horizontal post.

While the positioning of such a doorway sign in an otherwise open doorway at a height well elevated over the floor improves on the visibility of the sign over floor seated signs and further ensures that it is noticed by also acting as a barrier or obstruction to passage through the doorway, the doorway sign shares a different problem with floor resting signs, in that cleaning personnel going room to room in a large establishment like a hotel, hospital, nursing home, care home, etc. need to transport a sign to each room, and likely need to carry multiple signs with them, as they will almost certainly need to move to a next room while the cleaned floor in the preceding room is still wet and still presents a slipping hazard.

Accordingly, there remains room for improvement in the field of wet floor caution products and methods.

SUMMARY OF THE INVENTION

According to a first aspect of the invention there is provided a wet floor warning and barrier device comprising:

a barrier member movably mounted proximate a doorway at a height elevated above floor level and selectively movable between a deployed position in which the barrier member spans at least partially across the doorway and a storage position in which the barrier member is less obstructive to the doorway than in the deployed position; and indicia presented on the barrier member in a position viewable from an area approaching the doorway with the barrier member in the deployed position, the indica being indicative that a floor surface situated beyond said doorway from the approaching area may be wet and present a slip and fall hazard.

Preferably the barrier member is supported proximate an end thereof by a pivot mount beside the doorway for pivoting between the deployed and storage positions.

Preferably the barrier member, in the storage position, extends in a direction that follows along a side of the doorway more than in the deployed position.

Preferably the barrier member extends horizontally from the pivot mount in a direction crossing the doorway in the deployed position and extends vertically from the pivot mount in the storage position.

Preferably the barrier member is supported on a wall through which the doorway passes.

Preferably the barrier member is entirely unobstructive to the doorway in the storage position.

According to a second aspect of the invention there is provided a wet floor warning and barrier device comprising:

a barrier member mountable proximate a doorway at a height elevated above floor level in a manner selectively movable between a deployed position in which the barrier member spans at least partially across the doorway and a storage position in which the barrier member is less obstructive to the doorway than in the deployed position; and indicia presented on the barrier member in a position viewable from an area approaching the doorway with the barrier member mounted and in the deployed position, the indica being indicative that a floor surface situated beyond said doorway from the approaching area may be wet and present a slip and fall hazard.

Preferably there is provided a pivot bracket mountable on a wall surface to movably support the barrier member on a wall for movement along the wall surface.

Preferably the indicia is presented on the barrier member on a side thereof opposite additional indica that is also indicative of a wet floor surface.

Preferably the barrier member comprises an elongated member.

Preferably there are provided stops operable to prevent movement of the barrier member past the deployed and storage positions.

At least one stop may comprise a locking mechanism operable to secure the barrier member in a respective one of the deployed and storage positions. The locking mechanism may comprise a clip operable to engage and disengage the barrier member.

According to a third aspect of the invention there is provided a method of warning approachers of a doorway of a wet floor surface beyond said doorway, the method comprising deploying a barrier member installed proximate the doorway into a position extending at least partially across the doorway from a storage position in which the barrier member is less obstructive to the doorway than in the deployed position so that indicia on the barrier member is displayed on a path of sight through the doorway to indicate that the floor surface situated beyond said doorway is wet.

According to a fourth aspect of the invention there is provided a method of facilitating wet floor warnings, the method comprising installing a movable barrier member proximate a doorway at a height elevated above floor level for selective movement between a deployed position in which the barrier member spans at least partially across the doorway and a storage position in which the barrier member is less obstructive to the doorway than in the deployed position for selective display of wet floor warning indicia on the barrier member on a path of sight through the doorway to indicate that the floor surface situated beyond said doorway is wet and may present a slip and fall hazard.

BRIEF DESCRIPTION OF THE DRAWINGS

In the accompanying drawings, which illustrate exemplary embodiments of the present invention:

FIG. 2 is a close up elevational view of the wet floor warning and barrier device of FIG. 1.

FIG. 3 is a cross sectional view of the wet floor warning and barrier device of FIG. 2 as taken along line A-A thereof.

FIG. 4 is a cross sectional view of the wet floor warning and barrier device of FIG. 2 as taken along line B-B thereof.

FIG. 5 is an elevational view of an alternate embodiment wet floor warning and barrier device.

FIG. 6 is an exploded perspective view of the wet floor warning and barrier device of FIG. 5.

DETAILED DESCRIPTION

Figure 1:
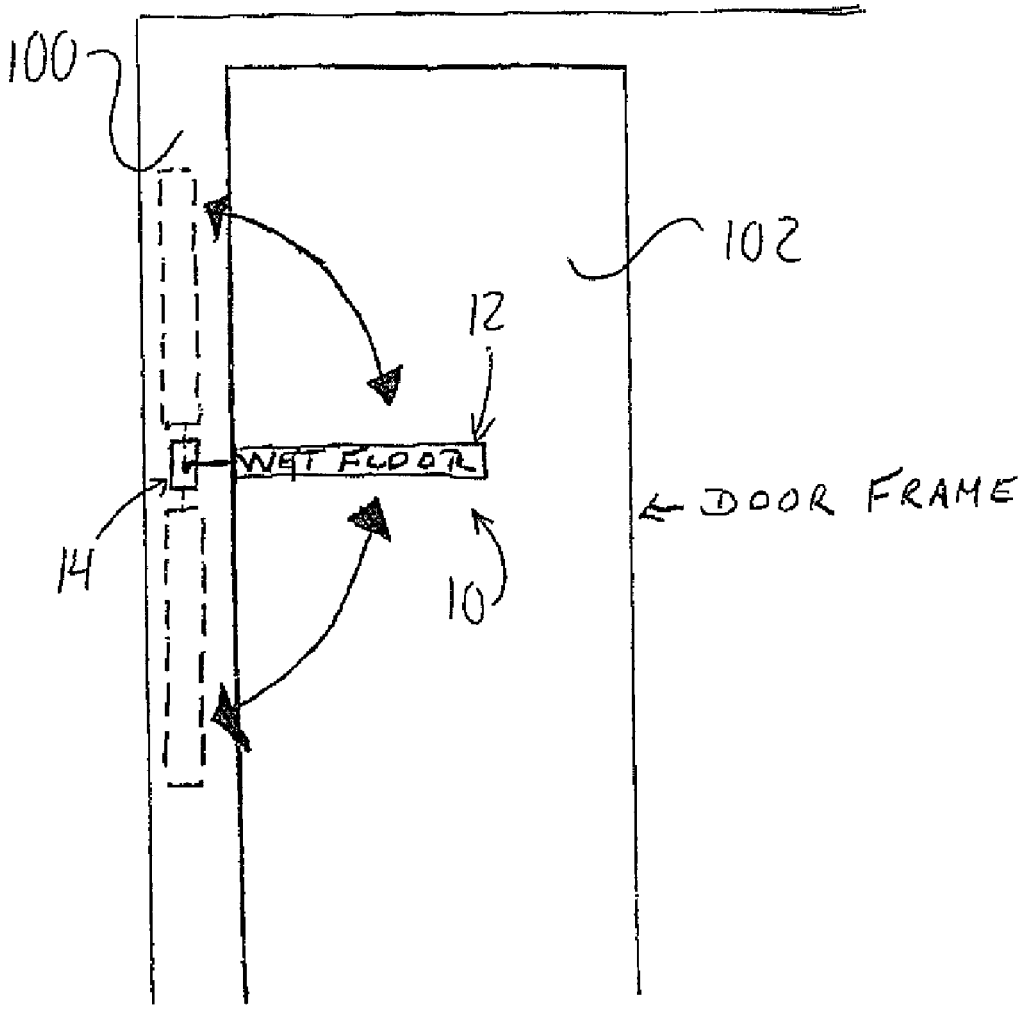
FIG. 1 is a schematic illustration of a wet floor warning and barrier device of the present invention installed at a room's entrance doorway.

FIG. 1 shows a wet floor warning sign and barrier device 10 of the present invention installed on an internal wall structure 100 of a building at a position adjacent a doorway 102 in the wall structure. The device 10 features a barrier member 12 pivotally carried on a mounting bracket 14 that has been fastened to the wall structure a short lateral distance outward from the doorway. The barrier member 12 is pivotal along a vertical plane for selected movement between into and out of a useful position in which the member at least partially obstructs passage through the room entrance presented by the doorway 102. The barrier member has indica thereon to display a warning to people approaching the doorway that the floor of the room located through the doorway may be slippery and the person should therefore either avoid entry to the room altogether or tread cautiously when entering the room. FIG. 1 shows the barrier member deployed in the useful position extending in a direction crossing the doorway at an elevation above floor level so that the warning indicia are readily viewable from the sightline of the average person. Even if the barrier member is not notice by an approacher, actual physical contact will take place between the person and the barrier member should the person attempt to pass through the doorway, thus ensuring the person will take notice of the device and heed its warning of a potential slip and fall hazard beyond the doorway.

FIG. 2 shows one embodiment of the device 10 in greater detail. The barrier device features a thin, flat sign plate 16 that has an elongated planar rectangular shape and has the warning "wet floor" prominently displayed on each of the two opposing rectangular faces of the sign plate 16 in large letters spanning substantially the full width of the elongated sign plate so that the words read along the sign plate's lengthwise dimension.

A support 18 is fixed to the sign plate 16 and projects from one end of the sign plate 16 in the direction corresponding to the lengthwise dimension thereof. The illustrated support 18 has an overall shape like an eyebolt, with a straight stem 18*a* portion projecting from the sign plate 16 to carry a loop 18*b* at the end of the support opposite the sign plate 16.

The mounting bracket 14 features a base plate 20 having opposing faces, one of which rests flat against the finished surface of the wall structure 100 when the bracket is installed, and the other of which faces outwardly away from the wall. The outer face 20*a* of the base plate features a cylindrical post or peg 22 projecting perpendicularly outward from it, around which the loop 18*b* of the support 18 closes so that the support 18 and attached sign plate 16 are pivotal about the axis of the of the peg 22. The base plate 20 of the mounting bracket 14 is fixed to the wall structure, for example using screws 24 threaded into a wall stud or drywall anchors through fastener holes provided in the base plate 20.

As shown in FIG. 3, the length by which the peg 22 projects from the base plate exceeds the thickness of the support that wraps around it, thereby allowing sliding displacement of the support back and forth along the peg 22. A head 26 at the end of the peg 22 opposite the base plate 20 has a diameter that exceeds both the outer diameter of the peg 22 and the inner diameter of the loop 18*b* of the support 18. The head 26 thus blocks sliding of the support loop 18*b* off the end of the peg in order to keep the loop 18*b* on the peg 22 between the base plate 20 and the head 26. The head 26 may be releasably fastened to the peg 22, for example by threaded engagement if the peg 22 is hollow and internally threaded at its outer end and the head 26 has a matable externally threaded shaft projecting from it, or the head 26 may instead be permanently fixed to the peg 22.

The illustrated embodiment has three resilient clips carried on the base plate 20 spaced around the peg 22 at radial distances from the axis thereof that are outward from the loop 18*b* closing therearound, but are less than the radial distance from the peg axis to the sign plate 16 at the opposite end of the support stem 18*a*. Two of the clips 28 are diametrically opposite across the axis of the peg 22 and are used at these opposing positions directly above and below the peg 22 to retain the support 18 and sign plate 16 of the barrier member in storage positions extending along the vertical side of the doorway adjacent which the mounting bracket is installed, as shown by the broken line positions of the barrier member 12 in FIG. 1. A third clip 30 positioned at ninety degrees around the peg axis from each of the two storage clips 28 to reside laterally outward from the peg at an equal elevation thereto. The third peg is used to maintain the support 18 and sign plate 16 of the barrier member in the deployed position extending perpendicularly from the vertical side of the doorway in a lateral direction oriented across the doorway, as shown by the solid line position of the barrier member 12 in FIG. 1.

Each clip is generally C-shaped, with the central span 32 of the C-shape fixed to the base plate 20 to leave two curved arms 34 projecting outward from the base plate 20 on opposite sides of the C-shapes central span 32. The space or gap 36 between the curved arms 34 at the open side of the C-shape is less than the diameter of the stem 18*a* of the support 18 when the clip is in its normal condition, while the inner radius of curvature of the C-shape is sufficient to accommodate the stem 18*a* therein. Therefore, with the gap 36 between the curved arms of the C-shape widening in a direction moving outward from inside the C-shape, the resiliency of the clip arms means that forcing the stem 18 against the distal ends of the clips arms at the gap 36 therebetween will cause the ends of the arms 34 to momentarily deflect apart until the stem 18 passes between them and completes entry into the interior space of the C, at which point the resilient arms 34 return to their normal positions, thereby capturing the stem 18*a* of the support 18 inside the clip. To subsequently release the support stem 18*a* from the clip, the stem is pulled outward from the clip, which again momentarily forces the clip ends apart to accommodate passage of the stem between them before returning to the clips normal condition. The orientation of the third peg 30 is rotated ninety degrees about an axis perpendicular to the base plate relative to the first storage pegs 28, so that the arm ends of the third peg 30 are vertically spaced from one another while the arm ends of each of the storage pegs 28 are horizontally spaced from one another.

As shown in FIG. 3, the peg 22 projects further from the base plate 20 than each clip 28, 30 by an amount greater than the thickness of the of the support stem 18 (as defined by the diameter thereof). Accordingly, with the support 18 pulled outwardly away from the base plate 20 to a position near or against the head 26, the support 18 is positioned outwardly past the clips and thus is free to rotate or pivot fully around the peg 22. In this pulled-out position, the support 18 can thus be pivoted in a vertical plane between either of the storage positions (shown in broken lines in FIG. 1) and the deployed position (shown in solid lines in FIG. 1), or vice versa. The support 18 is then lockable in the selected position by pushing the support 18 back toward the base plate 20 from this pulled-out position over the selected one of the clips so that the clip captures the stem 18*a* of the support to secure it in the selected position until later withdrawn from the clip.

With reference to FIG. 1, in either of the vertical storage positions, the support 18 and sign plate 16 of the barrier member 12 are withdrawn entirely from in front of the doorway, leaving the entrance to the room, hallway or other area beyond the door entirely unobstructed while the member remains locked in place along the vertical door jamb or casing at the side of the doorway by the top or bottom one of the three clips. When the barrier member 12 is in the deployed position extending cross-wise in front of the door, the "wet floor" warning is readily visible along a sightline through the doorway from an area approaching the doorway. As its own entity separate from any door mounted in the doorway, the sign is readily recognizable when deployed in an otherwise open doorway. Permanently mounted to the wall adjacent the doorway, cleaning staff in a hospital, nursing home, care home or other large building or residence need not transport any wet floor sign around the building. The barrier member is simply deployed when needed to prevent room occupants or visitors from entering a room with a wet or slippery floor, or to at least warn them of the potential hazard, and then is simply moved back to a storage position until next required during subsequent cleaning rounds. The device can be used on any doorway or entranceway, regardless of whether an openable and closeable door is also hung there.

Any of a number of known materials may be employed for production of the above device, but materials and structures with a balance between light-weight characteristics with sufficient strength to avoid significant damage if the barrier member was accidentally walked into would is desirable. However, even constructions that would be damaged in such a scenario could be employed, with the invention that the affected parts could be replaced as required.

It will be appreciated that significant changes in the above-detailed structure may be made without departing from the basic principles of the present invention. For example, the barrier member need not have separate support and sign structures, as a single bar or plate presenting opposing faces for the warning indicia could instead simply have a through hole adjacent one end for fitting over the pivot peg and could similarly engage clips or other locking mechanisms in the storage and deployed positions. Similarly, the mounting bracket could be supported adjacent the doorway in ways other than the described mounting of a plate against the outer finishing surface of the wall, for example mounted on an upright post anchored to the floor in front of the wall adjacent the doorway or on a support structure depending downward from the ceiling. It may be possible to have alternate embodiments in which the barrier member is spring biased into a default one of the possible positions. The device need not necessarily have more than one storage position, one of which may be a free-hanging storage position in which the barrier member simply hangs vertically downward from its pivot support without need for further latching or locking.

Another embodiment may employ an over-center storage position in which a stop feature on the mounting bracket projects outwardly away from the wall to block pivoting of the barrier member past a position extending upward from the mounting bracket, but at an oblique angle extending away from the doorway. Similarly, a lock, clip or latch corresponding to the deployed position could be omitted by likewise using a stop feature to simply block rotation past a horizontally deployed position extending across the doorway, thereby using a pair of stop features to limit movement of the barrier member between an upright storage position and a laterally projecting deployed position. FIGS. 5 and 6 show such an embodiment, which does not require the axial sliding of the barrier member along the pivot axis used in the illustrated embodiment to engage and disengage the locking clips.

Embodiments in which the barrier member is pivotal between a deployed position and a single vertical storage position may have each clip oriented differently relative to the base so that the stem of the support engages and disengages the clip by pivotal movement of the support about the peg axis in opposite directions rather than by axial sliding movement of the support along the peg axis in opposite directions. The peg could be shortened to maintain a consistent position of the support along the peg axis in alignment with the open sides or mouths of the clips, and operation of the device would require only pivotal movement of the support. Each clip would be oriented ninety degrees out the orientation of the respective clip of the illustrated embodiment about the axis around which the C-shape of the clip partially closes. A storage clip in the position of one of the two illustrated storage clips would open toward the side of the mounting bracket to which the support extends when deployed, and the other clip would open upwardly or downwardly toward the one storage clip.

It will also be appreciated that the indicia or markings on the barrier member need not necessarily be limited to a written expression such as "wet floor". It is known in the art to employ a slip and fall warning illustration along with or instead of a written warning to better ensure understanding of the warning regardless of the written language(s) known to the viewer. Also, written messages like "closed for cleaning" or similar warning may likewise prevent entry to the room marked with the deployed device without necessarily making direct reference to a wet or slippery floor. Embodiments of the present invention include devices with warnings presented in different languages, and devices that have multiple languages on each unit. It may be possible to employ similar devices to provide other warnings, but at this time it is contemplated that wet or slippery floors that often result from cleaning procedures would be the most common application where a solution is required on a large enough scale to warrant installation of a dedicated device for each room or area concerned.

Although not illustrated, the device may include a concealing panel behind which the barrier members pivots when moved into the storage position so that the wet floor warning is concealed from site when the barrier member is in the storage position. Such a concealing feature may be part of the mounting bracket or may be a component of a different piece separately mounted to the wall adjacent the doorway therein. Other ways of configuring the device to only display the warning when deployed may alternatively be employed. Another embodiment may feature a mounting bracket configured to attach to a ceiling structure instead of a wall structure, and allows the sign to be moved from a raised storage position adjacent the ceiling to a lowered deployed position further from the ceiling and thus more visible. Such an embodiment may use pivoting of an elongate member like the illustrated embodiment, but with any warning indicia re-oriented so as to be readable with the elongate member in a vertical deployed position hanging downward from the bracket. Such an embodiment can be employed at locations other than at doorways connecting different rooms or areas of a building, for example along hallways.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. Wet floor warning and barrier device comprising:

a mounting bracket mounted to a wall surface of a wall at a height elevated above floor level at a position adjacent to, and outside of, a doorway passing through said wall;

a barrier member carried on the mounting bracket and being movable in a vertical plane parallel to the wall surface between a deployed position in which the barrier member spans at least partially across the doorway and a storage position in which the barrier member is less obstructive to the doorway than in the deployed position; and indicia presented on the barrier member in a position viewable from an area approaching the doorway with the barrier member in the deployed position, the indica being indicative that a floor surface situated beyond said doorway from the approaching area may be wet and present a slip and fall hazard.

2. The device of claim 1 wherein the barrier member is pivotally supported on the mounting bracket.

3. The device of claim 1 wherein the barrier member, in the storage position, extends in a direction that follows along a side of the doorway more than in the deployed position.

4. The device of claim 1 wherein the barrier member extends horizontally from the pivot mount in a direction crossing the doorway in the deployed position and extends vertically from the pivot mount in the storage position.

5. The device of claim 1 wherein the barrier member is entirely unobstructive to the doorway in the storage position.

6. The device of claim 1 wherein the indicia is presented on the barrier member on a side thereof opposite additional indica that is also indicative of a wet floor surface.

7. The device of claim 1 wherein the barrier member comprises an elongated member.

8. The device of claim 1 wherein the mounting bracket comprises stops operable to prevent movement of the barrier member past the deployed and storage positions.

9. The device of claim 8 wherein at least one stop comprises a locking mechanism operable to secure the barrier member in a respective one of the deployed and storage positions.

10. The device of claim 9 wherein the locking mechanism comprises a clip operable to engage and disengage the barrier member.

11. Wet floor warning and barrier device comprising:

a mounting bracket mountable to a wall surface of a wall at a height elevated above floor level at a position adjacent to, and outside of, a doorway that passes through said wall with a face of said mounting bracket placed flat against said wall surface;

a barrier member carried on the mounting bracket in a manner selectively movable in a plane parallel to said face of the mounting bracket so as to be movable parallel to said wall surface between a deployed position in which the barrier member spans at least partially across the doorway and a storage position in which the barrier member is less obstructive to the doorway than in the deployed position; and indicia presented on the barrier member in a position viewable from an area approaching the doorway with the barrier member mounted and in the deployed position, the indica being indicative that a floor surface situated beyond said doorway from the approaching area may be wet and present a slip and fall hazard.

12. The device of claim 11 wherein the barrier member is pivotally supported on the mounting bracket.

13. The device of claim 11 wherein the barrier member comprises an elongated member.

14. The device of claim 11 wherein the mounting bracket comprises stops operable to prevent movement of the barrier member past the deployed and storage positions.

15. The device of claim 14 wherein at least one stop comprises a locking mechanism operable to secure the barrier member in a respective one of the deployed and storage positions.

16. The device of claim 15 wherein the locking mechanism comprises a clip operable to engage and disengage the barrier member.

17. A method of facilitating wet floor warnings, the method comprising installing a movable barrier on a wall surface of a wall at a position adjacent to, and outside of, a doorway that passes through said wall at a height elevated above floor level for selective movement in a vertical plane parallel to said wall surface between a deployed position in which the barrier member spans at least partially across the doorway and a storage position in which the barrier member is less obstructive to the doorway than in the deployed position for selective display of wet floor warning indicia on the barrier member on a path of sight through the doorway to indicate that the floor surface situated beyond said doorway is wet and may present a slip and fall hazard.

* * * * *